US006668768B2

(12) United States Patent
Styron et al.

(10) Patent No.: US 6,668,768 B2
(45) **Date of Patent: *Dec. 30, 2003**

(54) VARIABLE COMPRESSION RATIO ENGINE

(75) Inventors: Joshua Putman Styron, Canton, MI (US); Pravin Sashidharan, Inkster, MI (US); V. Durga Nageswar Rao, Bloomfield Hills, MI (US); Yash Andrew Imai, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 15 days.

This patent is subject to a terminal disclaimer.

(21) Appl. No.: 10/003,355

(22) Filed: Nov. 15, 2001

(65) Prior Publication Data

US 2003/0089320 A1 May 15, 2003

(51) Int. Cl.[7] ..... F02B 75/02
(52) U.S. Cl. ..... 123/48 B; 123/48 R
(58) Field of Search ..... 123/48 B, 48 R

(56) References Cited

U.S. PATENT DOCUMENTS

| | | | | |
|---|---|---|---|---|
| 4,246,873 A | | 1/1981 | Lih-Liaw | |
| 4,286,552 A | | 9/1981 | Tsutsumi | |
| 4,370,901 A | * | 2/1983 | Bolen | 123/48 B |
| 4,469,055 A | | 9/1984 | Caswell | |
| 4,934,347 A | | 6/1990 | Suga et al. | |
| 4,979,427 A | | 12/1990 | Pfeffer et al. | |
| 5,146,879 A | * | 9/1992 | Kume et al. | 123/48 B |
| 5,331,928 A | | 7/1994 | Wood | |
| 5,417,185 A | | 5/1995 | Beattie | |
| 5,562,068 A | * | 10/1996 | Sugimoto et al. | 123/48 B |
| 5,724,863 A | * | 3/1998 | Kramer et al. | 123/48 R |
| 5,865,092 A | | 2/1999 | Woudwyk | |
| 5,960,750 A | * | 10/1999 | Kreuter | 123/48 B |
| 6,223,703 B1 | | 5/2001 | Galvin | |
| 6,386,153 B1 | * | 5/2002 | Rao et al. | 123/48 B |
| 6,394,047 B1 | * | 5/2002 | Rao et al. | 123/48 B |
| 6,412,453 B1 | * | 7/2002 | Rao et al. | 123/48 B |

FOREIGN PATENT DOCUMENTS

| | | |
|---|---|---|
| JP | 3-092552 | 4/1991 |
| JP | 6-241058 | 8/1994 |

OTHER PUBLICATIONS

U. S. patent application Ser. No. 09/682,682, filed Oct. 5, 2001, entitled "Variable Compression Connecting Rod".
U.S. patent application Ser. No. 09/691,666, Filed Oct. 18, 2000, "Apparatus for Varying the Compression Ratio of an Internal Combustion Engine", V. Durga N. Rao et al.
U.S. patent application Ser. No. 09/682,263, Filed Aug. 10, 2001, "Connecting Rod for a Variable Compression Engine", V. Durga N. Rao et al.
"Variable Compression Ratio (VCR) Crank Mechanism", Victor Gheorghiu, University of Applied Sciences, Hamburg, Germany, 1 pp.
"New Saab and Citroen technology at Geneva", Automotive Engineering International, May 2000, pp. 96, 97.

* cited by examiner

*Primary Examiner*—Henry C. Yuen
*Assistant Examiner*—Jason Benton
(74) *Attorney, Agent, or Firm*—Allan J. Lippa

(57) ABSTRACT

A connecting rod assembly is provided for varying a compression ratio of an internal combustion engine having a crankshaft and a piston. The assembly includes a first portion adapted to be connected to the crankshaft and having a cylindrical aperture. The assembly further includes a second portion adapted to be connected to the piston and movable with respect to the first portion. In addition, the assembly includes a locking element having a cylindrical portion that is disposed at least partially in the cylindrical aperture. The locking element is movable between an unlocked position and a locked position for locking the second portion at a first position relative to the first portion, wherein the first position corresponds to a first compression ratio of the engine.

25 Claims, 6 Drawing Sheets

VARIABLE COMPRESSION RATIO ENGINE

BACKGROUND OF THE INVENTION

1. Field of the Invention

The invention relates to a variable compression connecting rod for use with an internal combustion engine.

2. Background Art

A "compression ratio" of an internal combustion engine is defined as the ratio of the volume in a cylinder above a piston when the piston is at bottom-dead-center (BDC) to the volume in the cylinder above the piston when the piston is at top-dead-center(TDC). The higher the compression ratio, the more the air and fuel molecules are mixed and compressed, thereby resulting in increased efficiency of the engine. This in turn results in improved fuel economy and a higher ratio of output energy versus input energy of the engine.

In conventional internal combustion engines, however, the compression ratio is fixed and cannot be changed to yield optimal performance. Accordingly, variable compression ratio (VCR) internal combustion engines have been developed to vary the clearance volume of a cylinder in order to achieve improved fuel economy and increased engine power performance. Such VCR engines are designed to have a higher compression ratio during low load conditions, and a lower compression ratio during high load conditions. Known techniques include using "sub-chambers" and "sub-pistons" to vary the volume of a cylinder (see, for example, U.S. Pat. Nos. 4,246,873 and 4,286,552), varying the actual dimensions of all or a portion of a piston attached to a fixed length connecting rod (see U.S. Pat. No. 5,865,092), and varying the actual length of a connecting rod (see U.S. Pat. No. 5,724,863).

Other techniques include the use of eccentric rings or bushings either at the lower "large" end of a connecting rod or the upper "small" end of the connecting rod for varying the effective length of the connecting rod or height of a reciprocating piston. U.S. Pat. Nos. 5,417,185, 5,562,068 and 5,960,750 and Japanese Publication JP-03092552 disclose devices that include eccentric rings. These eccentric ring devices, however, are undesirable in that each eccentric ring must be rotated 180 degrees before one of the desired operating modes or positions is engaged. As a result, locking of the eccentric ring in a proper position may not occur within an optimum period of time, thereby leaving the effective length of the device and consequently the compression ratio of an associated cylinder in an undesired intermediate state.

SUMMARY OF THE INVENTION

The invention addresses the shortcomings of the prior art by providing a connecting rod assembly that may be transitioned quickly and reliably between two or more compression modes without requiring rotation of an eccentric ring member about a crankpin or wrist pin.

The connecting rod assembly of the invention is configured to vary a compression ratio of an internal combustion engine having a crankshaft and a piston. The assembly includes a first portion adapted to be connected to the crankshaft and having a cylindrical aperture. The assembly further includes a second portion adapted to be connected to the piston and movable with respect to the first portion. In addition, the assembly includes a locking element having a cylindrical portion that is disposed at least partially in the cylindrical aperture. The locking element is movable between an unlocked position and a locked position for locking the second portion at a first position relative to the first portion, wherein the first position corresponds to a first compression ratio of the engine.

DETAILED DESCRIPTION OF THE PREFERRED EMBODIMENT(S)

Figure 1:
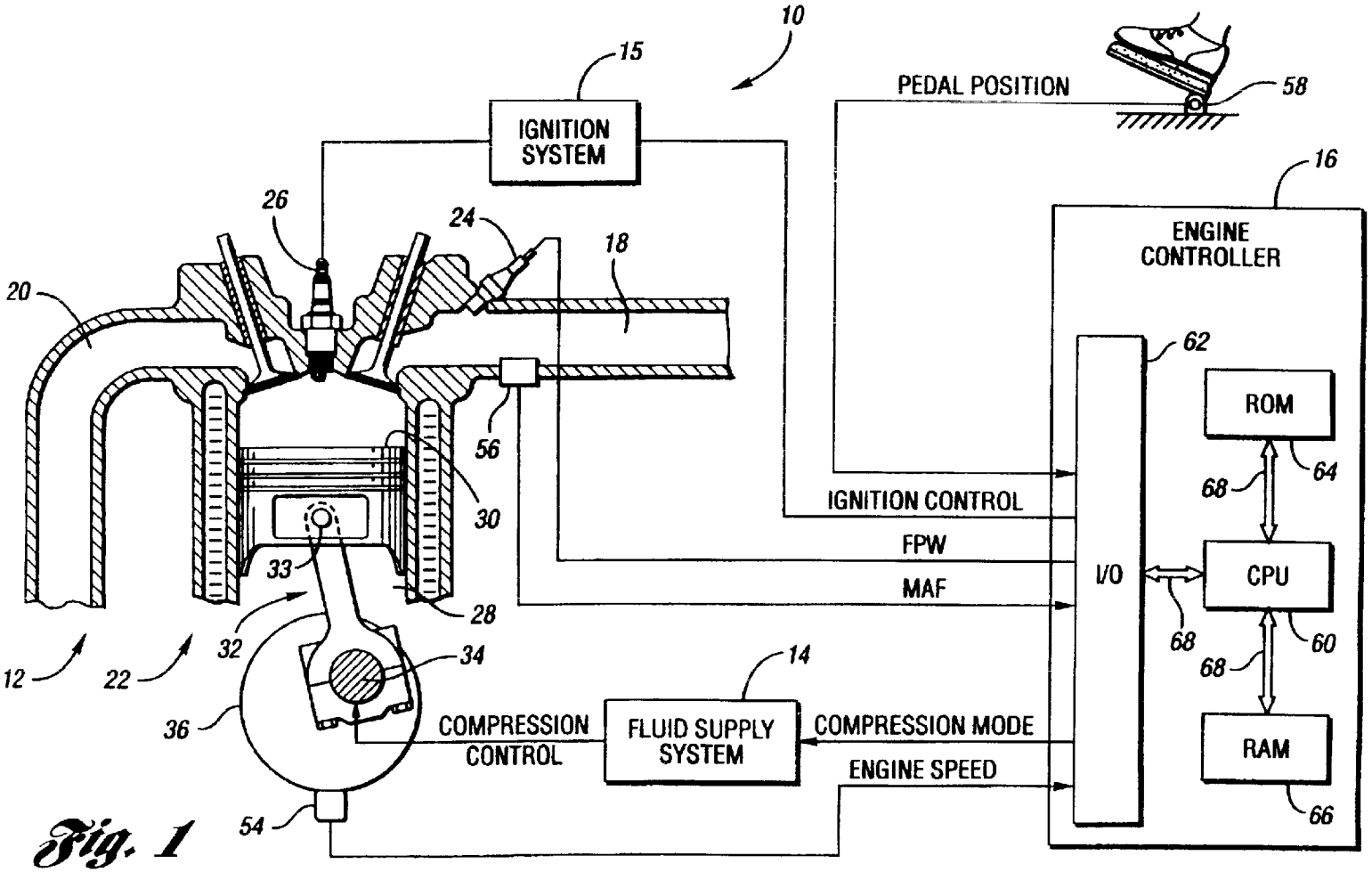
FIG. 1 is a diagram of a variable compression ratio system according to the invention including a variable compression ratio internal combustion engine, a fluid supply system and an engine controller in communication with the engine and the fluid supply system.
Figure 2:
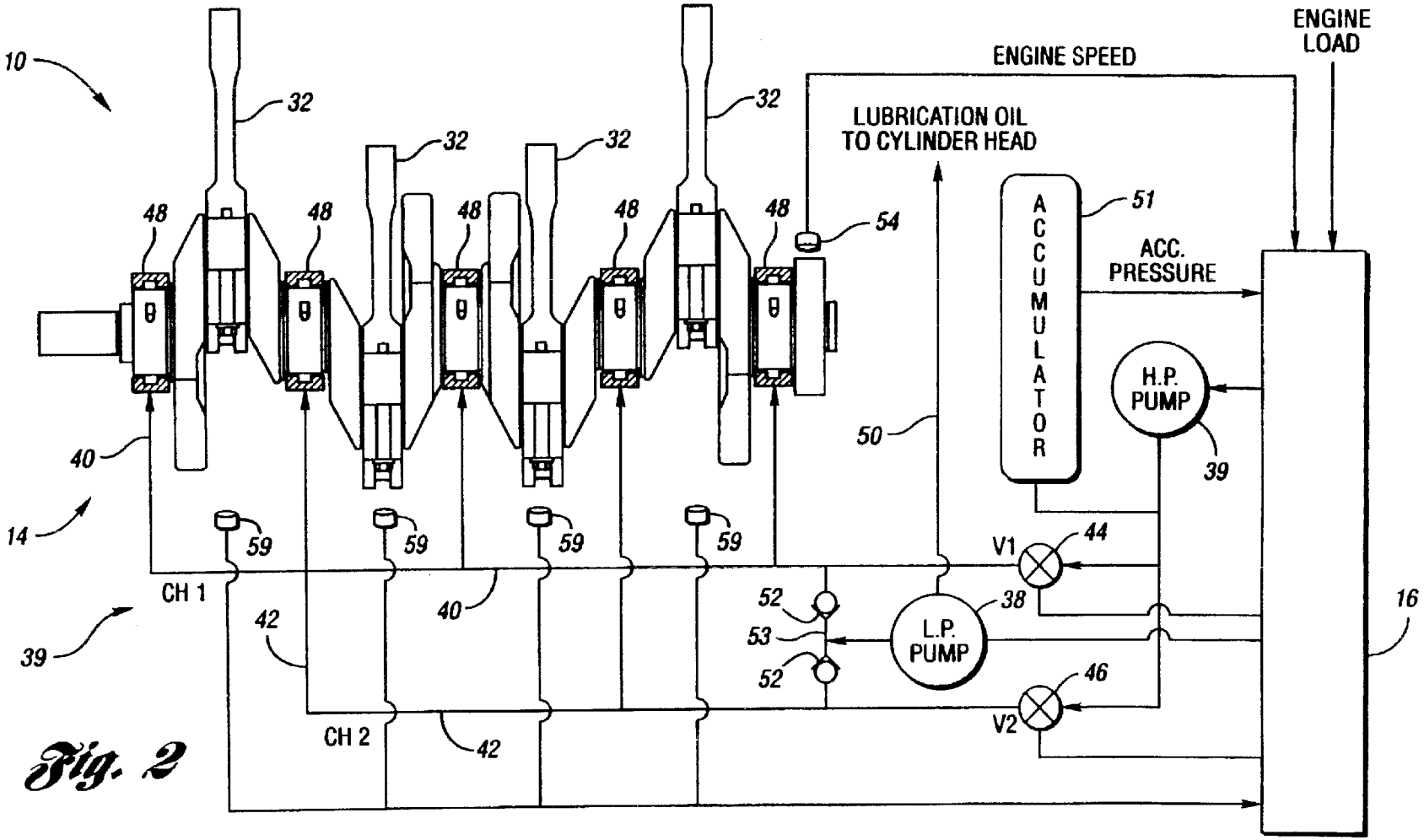
FIG. 2 is a diagram of the system of FIG. 1 showing multiple connecting rod assemblies of the engine.

FIGS. 1 and 2 show diagrams of a variable compression ratio system 10 according to the invention for use with a vehicle (not shown). The system 10 includes a variable compression ratio internal combustion engine 12, a fluid supply system 14 and an electronic control unit, such as engine controller 16, in electrical communication with the engine 12 and fluid supply system 14. While the engine 12, fluid supply system 14 and engine controller 16 are shown as separate components, the fluid supply system 14 and engine controller 16 may each be considered part of the engine 12.

The engine 12 shown in FIG. 1, by way of example and not limitation, is a gasoline, four-stroke, port fuel injection, internal combustion engine. Alternatively, the engine 12 may be any internal combustion engine, such as a direct fuel injection engine or a diesel engine. The engine 12 includes an air intake manifold 18, an exhaust manifold 20 and a plurality of cylinders 22 (only one shown) connected to the manifolds 18 and 20. Each of the cylinders 22 is fed fuel by one or more fuel injectors 24 and is supplied with an ignition spark by a spark plug 26. Furthermore, each cylinder 22 has a combustion chamber 28 for receiving a reciprocating piston 30. Each piston 30 is coupled to a connecting rod assembly 32 with a wrist pin 33, and each connecting rod assembly 32 is coupled to a crankpin 34 of a crankshaft 36.

Each connecting rod assembly 32 is in fluid communication with the fluid supply system 14, and is operative to vary the compression ratio of the engine 12 as explained below in greater detail. "Compression ratio" for a particular cylinder 22 is defined as the ratio of the volume in combustion chamber 28 above the piston 30 when the piston 30 is at bottom-dead-center (BDC) to the volume in the combustion chamber 28 above the piston 30 when the piston 30 is at top-dead-center (TDC). Although each connecting rod assembly 32 is described below as providing first and second or high and low compression ratios, each connecting rod assembly 32 may be configured to provide one or more intermediate compression ratios for the engine 12.

Referring to FIG. 2, the fluid supply system 14 includes first and second fluid supply devices, such as low and high pressure pumps 38 and 39, respectively, that supply pressurized oil to the engine 12. Each pump 38 and 39 may draw oil from a reservoir (not shown), which collects oil that drains from the engine 12. Furthermore, each pump 38 and 39 is in fluid communication with first and second passage arrangements 40 and 42, respectively. The first passage arrangement 40 includes a first valve 44, and the second passage arrangement 42 includes a second valve 46.

When both valves 44 and 46 are closed, the low pressure pump 38 may operate to provide oil at a first pressure to the engine 12 for lubrication purposes. Such oil may be provided, for example, through one or both passage arrangements 40 and 42 to main bearings 48, and/or through third passage arrangement 50 to the cylinder head (not shown) of the engine 12.

When one of the valves 44 or 46 is open, the high pressure pump 39 and/or an accumulator 51, which stores high pressure oil, may provide oil at a second pressure greater than the first pressure to one of the passage arrangements 40 or 42. This oil is then provided to the connecting rod assemblies 32 so as to cause a change in the effective length of the connecting rod assemblies 32, and thereby vary the compression ratio of the engine 12, as explained below in greater detail.

The fluid supply system 14 may further include check valves 52 for isolating the low pressure pump 38 from high pressure oil. The check valves 52 may be disposed in connector passage 53 that extends between the passage arrangements 40 and 42.

The fluid supply system 14 and connecting rod assemblies 32 may be operated to effect a change in the compression ratio of the engine 12 in accordance with one or more operating parameters, such as engine load and speed. Referring to FIG. 1, such parameters may be measured by appropriate sensors, such as crankshaft speed sensor 54, mass air flow (MAF) sensor 56 and pedal position sensor 58, which are electronically coupled to the engine controller 16. Referring to FIG. 2, the engine 12 may also include one or more position sensors 59 for sensing position of the connecting rod assemblies 32.

Returning to FIG. 1, the engine controller 16 includes a central processing unit (CPU) 60, input/output ports 62, read-only memory (ROM) 64 or any suitable electronic storage medium containing processor-executable instructions and calibration values, random-access memory (RAM) 66, and a data bus 68 of any suitable configuration. The engine controller 16 receives signals from a variety of sensors, such as sensors 54, 56, 58 and 59, and controls operation of the fluid supply system 14, the fuel injectors 24 and the spark plugs 26.

FIGS. 3 through 6 show one connecting rod assembly 32 according to the invention. The connecting rod assembly 32 includes a first portion, such as bearing retainer 69, that is adapted to be rotatably coupled to crankpin 34, and a second portion, such as body portion 70, that is adapted to be rotatably coupled to wrist pin 33. The bearing retainer 69 and body portion 70 may be manufactured in any suitable manner and may comprise any suitable material or materials, such as hardened steel.

The bearing retainer 69 is configured to retain a bearing 71 between the bearing retainer 69 and the crankpin 34, and includes a bearing retainer axis 72 that is coincident with crankpin axis 73. The bearing retainer 69 may further include first and second sections 74 and 75, respectively, that are joined together in any suitable manner, such as with bolts, screws or other suitable fasteners (not shown). In addition, the bearing retainer 69 includes first and second continuous, circumferential grooves or channels 76 and 77 that receive fluid from fluid supply system 14.

Figure 7:
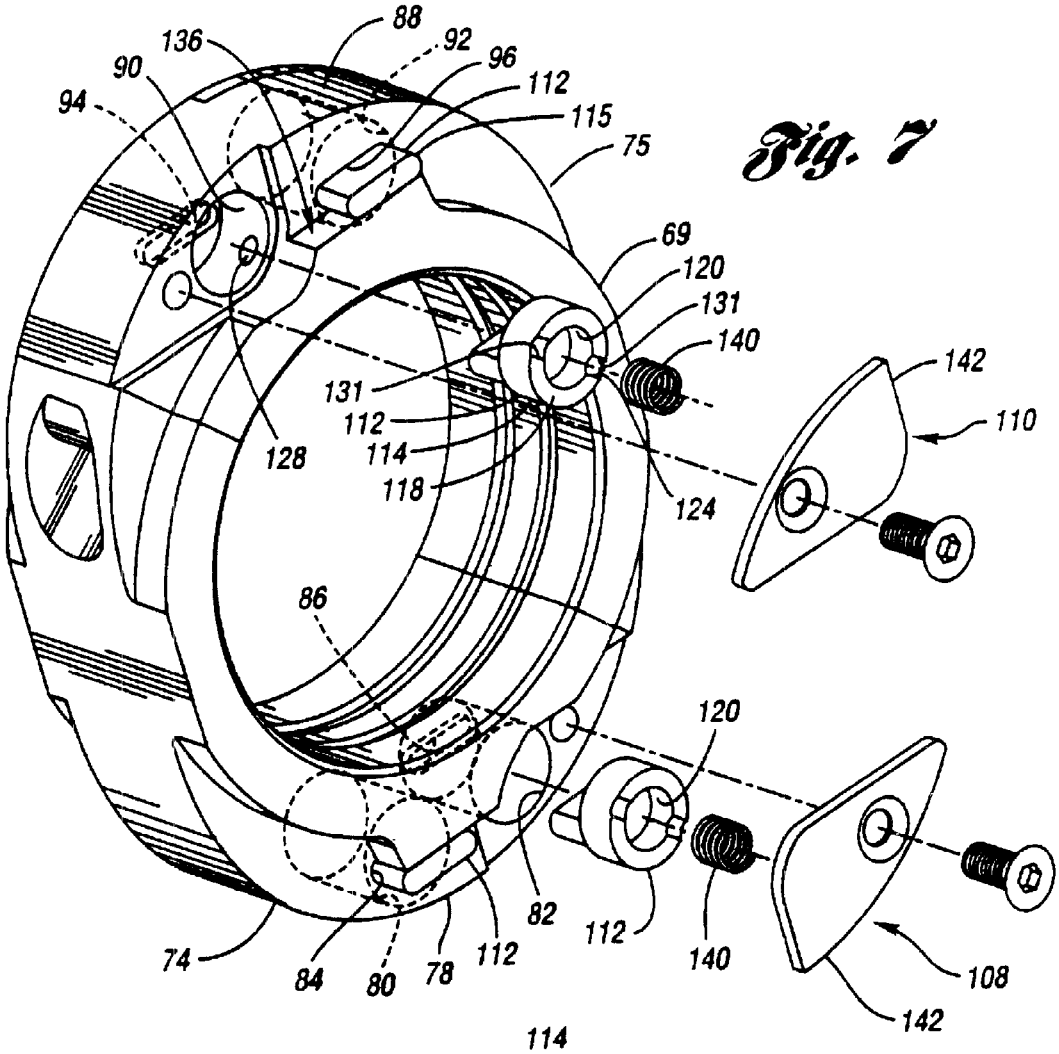
FIG. 7 is a partially exploded view of the bearing retainer and the locking mechanisms.

The bearing retainer 69 also includes one or more apertures disposed proximate each end of the bearing retainer 69. Referring to FIG. 7, for example, the first section 74 defines a first end 78 of the bearing retainer 69, and includes first and second cylindrical apertures or bores 80 and 82, respectively, disposed proximate the first end 78. The first section 74 further includes first and second extension apertures 84 and 86, respectively, extending from the first and second cylindrical bores 80 and 82, respectively. While each extension aperture 84 and 86 may have any suitable configuration, such as a cylindrical aperture or rectangular aperture, in the embodiment shown in FIG. 7, each extension aperture 84 and 86 is an oblong aperture defined by two generally planar surfaces joined together by arcuate or curved end surfaces.

Similarly, the second section 75 defines a second end 88 of the bearing retainer 69, and includes third and fourth cylindrical apertures or bores 90 and 92, respectively, disposed proximate the second end 88. The second section 75 further includes third and fourth extension apertures 94 and 96, respectively, extending from the third and fourth cylindrical bores 90 and 92, respectively. The extension apertures 94 and 96 may have any suitable configuration, such as described above with respect to the extension apertures 84 and 86.

Returning to FIGS. 3 and 4, the body portion 70 has a lateral axis 98 that is coincident with wrist pin axis 100, and a longitudinally extending body portion axis 102. In addition, the body portion 70 includes first and second sections 103 and 104, respectively, and each section 103 and 104 defines a generally semicircular aperture for receiving the bearing retainer 69. The sections 103 and 104 may be joined together in any suitable manner, such as with fasteners 106, so as to retain the bearing retainer 69 therebetween.

Figure 3:
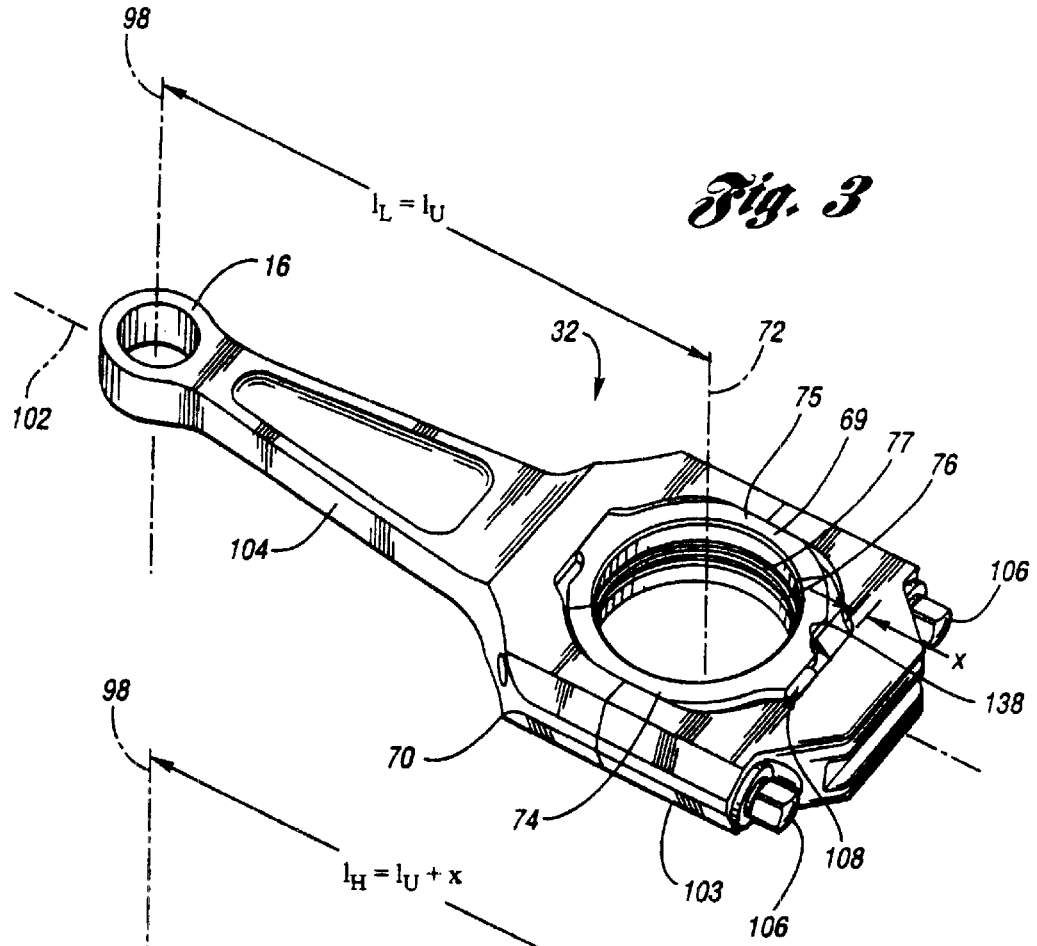
FIG. 3 is a perspective view of one connecting rod assembly shown in an unextended position, wherein the connecting rod assembly includes a bearing retainer and a body portion that is axially moveable with respect to the bearing retainer.
Figure 4:
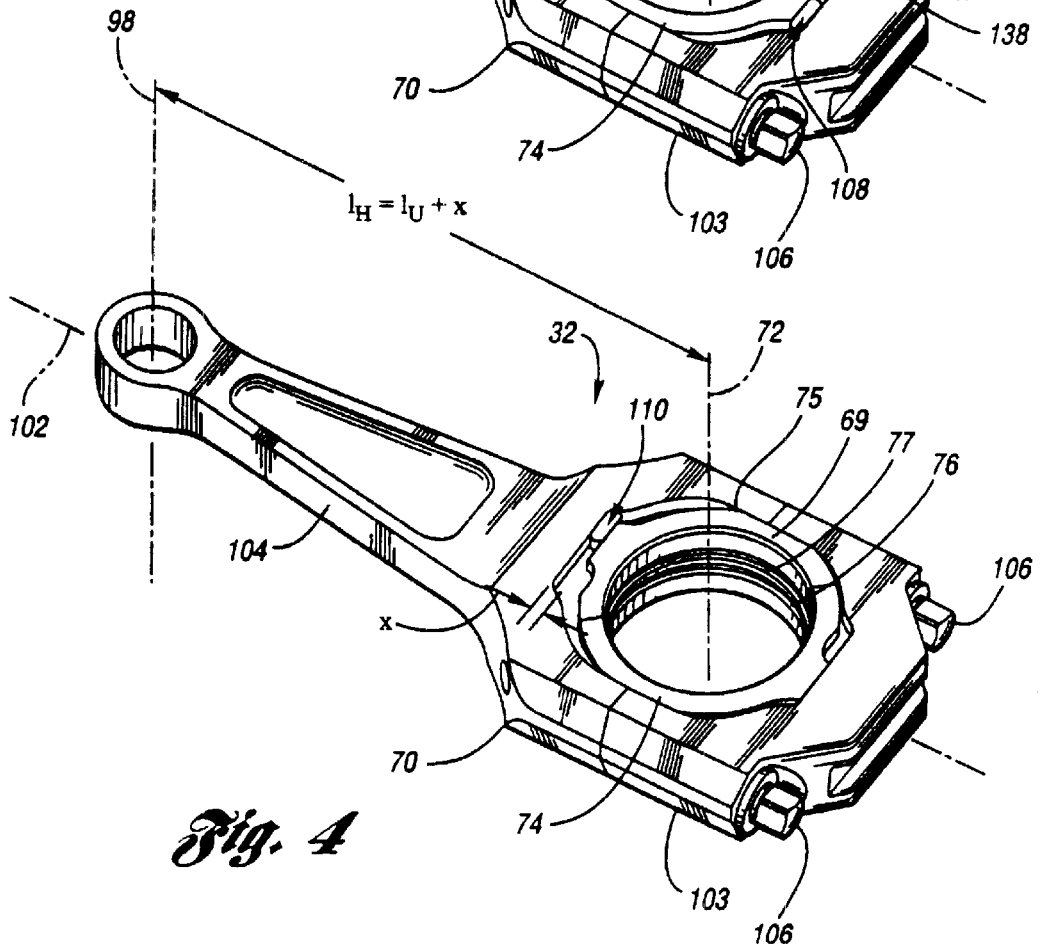
FIG. 4 is a perspective view of the connecting rod assembly shown in an extended position.
Figure 5:
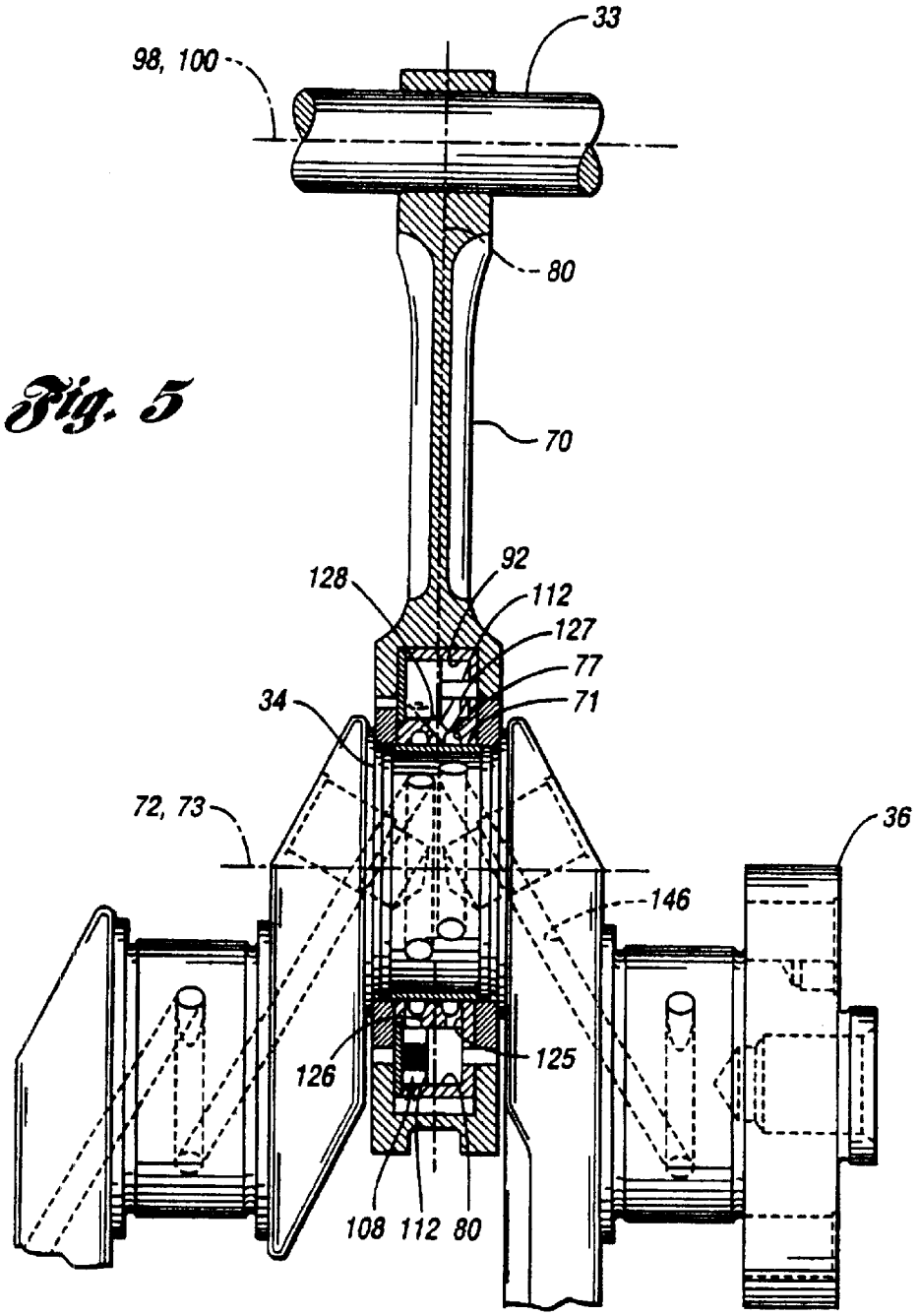
FIG. 5 is a cross-sectional view of the connecting rod assembly in the unextended position showing first and second locking mechanisms disposed between the bearing retainer and the body portion.
Figure 6:
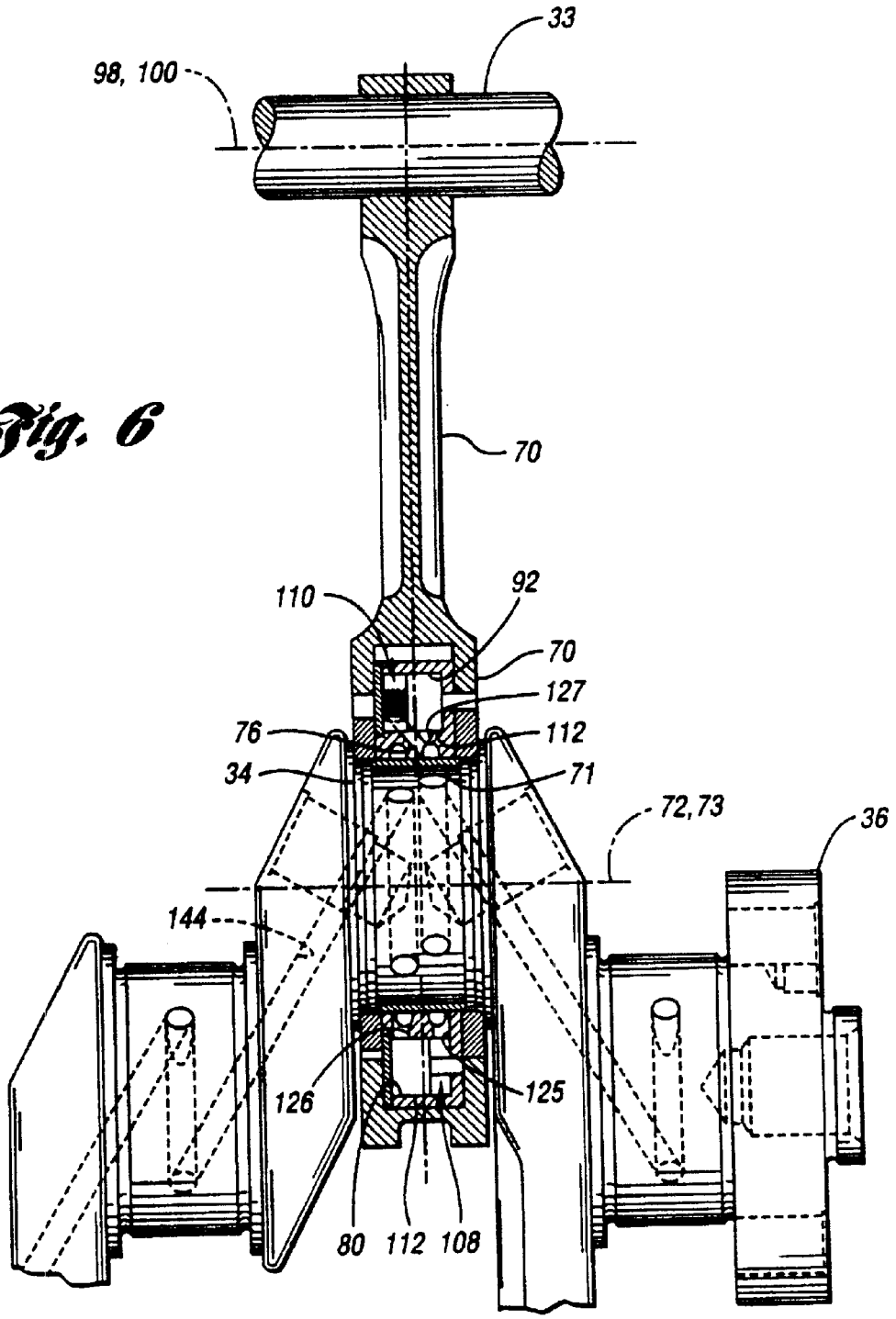
FIG. 6 is a cross-sectional view of the connecting rod assembly in the extended position.

Furthermore, the body portion 70 is axially movable with respect to the bearing retainer 69 between a first position, or unextended position shown in FIGS. 3 and 5, and a second position, or extended position shown in FIGS. 4 and 6. In the embodiment shown in FIGS. 3 through 6, for example, the body portion 70 is displaceable by a distance x. When the body portion 70 is in the unextended position, which corresponds to a first or low compression ratio mode of the engine 12, the effective length $l_L$ of the body portion 70 is equal to the unextended length $l_u$. When the body portion 70 is in the extended position, which corresponds to a second or high compression ratio mode of the engine 12, the effective length $l^H$ of the body portion 70 is equal to the extended length $l_u$+x. Thus, the body portion 70 is selectively displaceable with respect to the bearing retainer 69 so as to cause a change in the effective length of the body portion 70 and the compression ratio of the engine 12.

The connecting rod assembly 32 also includes first and second locking mechanisms 108 and 110, respectively, for locking the body portion 70 at the unextended and extended positions. Each locking mechanism 108 and 110 includes one or more locking elements 112 that are each moveable laterally between an unlocked position and a locked position. Referring to FIGS. 5 through 7, for example, each locking mechanism 108 and 110 includes two locking elements 112, and the locking elements 112 of a particular locking mechanism 108 or 110 are laterally moveable in opposite directions between unlocked and locked positions. When a particular locking element 112 is in the locked position, the locking element 112 extends into a gap formed between the bearing retainer 69 and the body portion 70. More specifically, when a particular locking element 112 is in the locked position, the locking element 112 overlaps and is engaged with the bearing retainer 69 and the body portion 70 (one locking element 112 of the first locking mechanism 108 is shown in the locked position in FIG. 5 and the unlocked position in FIG. 6, and one locking element 112 of the second locking mechanism 110 is shown in the unlocked position in FIG. 5 and the locked position in FIG. 6).

Figure 8:
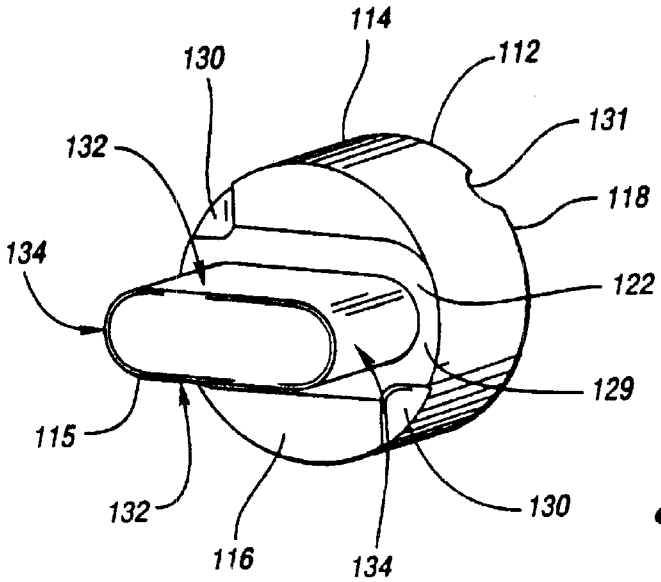
FIG. 8 is a perspective view of a locking element of the locking mechanisms.

Referring to FIGS. 7 and 8, each locking element 112 may be manufactured in any suitable manner and may comprise any suitable material, such as hardened steel. Each locking element 112 includes a cylindrical portion 114 disposed in a respective cylindrical bore 80, 82, 90 or 92, and a locking projection 115 extending from the cylindrical portion 114. Each cylindrical portion 114 is configured to closely mate with a respective cylindrical aperture 80, 82, 90 or 92 such that fluid leakage around the cylindrical portions 114 may be minimized. Furthermore, each cylindrical portion 114 has first and second ends 116 and 118, respectively, and a cylindrical aperture 120 extending from the second end 118 toward the first end 116. Each cylindrical portion 114 also includes first and second fluid passages 122 and 124, respectively, disposed at the first and second ends 116 and 118, respectively.

Referring to FIGS. 5 through 8, when the locking elements 112 of the first locking mechanism 108 are in the locked positions, each first fluid passage 122 of the first locking mechanism 108 is substantially aligned with a first unlocking fluid passage 125 that extends between a respective cylindrical bore 80 or 82 and the second channel 77. When the locking elements 112 of the first locking mechanism 108 are in the unlocked positions, each second fluid passage 124 of the first locking mechanism 108 is substantially aligned with a first locking fluid passage 126 that extends between a respective cylindrical bore 80 or 82 and the first channel 76.

Similarly, when the locking elements 112 of the second locking mechanism 110 are in the locked positions, each first fluid passage 122 of the second locking mechanism 110 is substantially aligned with a second unlocking fluid passage 127 that extends between a respective cylindrical bore 90 or 92 and the first channel 76. When the locking elements 112 of the second locking mechanism 110 are in the unlocked positions, each second fluid passage 124 of the second locking mechanism 110 is substantially aligned with a second locking fluid passage 128 that extends between a respective cylindrical bore 90 or 92 and the second channel 77.

The fluid passages 122 and 124 may have any suitable configuration for receiving fluid from the fluid supply system 14, as explained below in greater detail. In the embodiment shown in FIGS. 7 and 8, for example, each first fluid passage 122 may include a main portion or channel 129 that extends around a respective locking projection 115, and one or more connector portions or channels 130 that extend from the main channel 129 to the periphery of the cylindrical portion 114. Each second fluid passage 124 may include, for example, one or more generally radially extending channels 131 that extend between a respective cylindrical aperture 120 and the periphery of the cylindrical portion 114.

Still referring to FIGS. 7 and 8, each locking projection 115 is extendable through a respective extension aperture 84, 86, 94 or 96 so as create a compression fit between the bearing retainer 69 and the body portion 70 when the associated locking element 112 is in the locked position. Furthermore, each locking projection 115 is configured to closely mate with a respective extension aperture 84, 86, 94 or 96 such that the locking projections 115 substantially fill the extension apertures 84, 86, 94 and 96 when the locking elements 112 are in both the locked and unlocked positions. With such a configuration, fluid leakage from the cylindrical bores 80, 82, 90 and 92 may be minimized.

While each locking projection 115 may have any suitable configuration, such as a cylindrical projection or a rectangular projection, in the embodiment shown in FIGS. 7 and 8, each locking projection 115 includes two generally planar engaging surfaces 132 that are spaced apart from each other and generally parallel with each other. Each locking projection 115 further includes two arcuate or curved surfaces 134 that extend between the engaging surfaces 132. With such a configuration, each locking projection 115 may have a cross-section that is defined by two generally parallel lines joined by two semicircles. When a particular locking element 112 is in the locked position, one of the engaging surfaces 132 is engaged with a generally planar surface 136 of the bearing retainer 69, and the other engaging surface 132 is engaged with a generally planar surface 138 of the body portion 70.

Each locking mechanism 108 and 110 may further include one or more springs 140 and one or more cover plates 142 that are attachable to the bearing retainer 69. Each spring 140 is disposed between and engaged with a respective locking element 112 and a respective cover plate 142. Furthermore, each spring 140 is configured to urge a respective locking element 112 toward the locked position. In the embodiment shown in FIG. 7, each spring 140 is disposed at least partially in a cylindrical aperture 120 of a respective locking element 112. Each cover plate 142 is attachable to the bearing retainer 69, such as with fasteners, and is configured to retain a respective spring 140 and a cylindrical portion 114 of respective locking element 112 within a respective cylindrical bore 80, 82, 90 or 92.

Referring to FIGS. 3 through 6, a method for mounting the connecting rod assembly 32 on the crankshaft 36 will now be described. The method includes mounting first locking mechanism 108 on first section 74 of bearing retainer 69. The method further includes mounting second locking mechanism 110 on second section 75 of bearing retainer 69. The method further includes positioning bearing 71 around crankpin 34 of crankshaft 36, and then securing first and second sections 74 and 75 around the bearing 71 and crankpin 34, such as with fasteners or by any other suitable means. Next, the method involves positioning second section 104 of body portion 70 over second locking mechanism 110, such that second locking mechanism 110 is received in a portion of an aperture defined by second section 104. The method further includes positioning first section 103 of body portion 70 over first locking mechanism 108, such that first locking mechanism 108 is received in a portion of an aperture defined by first section 103. Next, the method involves moving the locking elements 112 of the first locking mechanism 108 to the unlocked position. The method further includes securing first section 103 to second section 104 in any suitable manner, such as with fasteners 106. Fasteners 106 may be, for example, bolts or screws.

Referring to FIGS. 2 and 5 through 8, operation of the system 10 will now be described in detail. First, the engine controller 16 may determine under which compression ratio mode the engine 12 is currently operating. This may be accomplished, for example, by sensing combustion pressure and/or by using the position sensors 59. When the engine controller 16 determines that it is desirable to change the compression ratio of the engine 12, based on one or more operating parameters such as engine speed and load, the engine controller 16 may control operation of fluid supply system 14 so as to supply pressurized oil from the high pressure pump 39 and/or accumulator 51 to the connecting rod assemblies 32. For example, if the engine controller 16 determines that it is desirable to change from high compression ratio mode shown in FIG. 6 to low compression ratio mode shown in FIG. 5, the engine controller 16 may open first valve 44 of fluid supply system 14 for a predetermined amount of time, such as 100 to 300 milliseconds, while keeping second valve 46 closed. As a result, pressurized oil is routed through first passage arrangement 40, and a pressure differential is created across the first and second passage arrangements 40 and 42, respectively, which activates the locking mechanisms 108 and 110 of the connecting rod assemblies 32.

More specifically, referring to FIG. 6, pressurized oil from first passage arrangement 40 may travel through first crankshaft passage arrangement 144 and first bearing aperture or apertures (not shown) in bearing 71, and then into first channel 76 of bearing retainer 69. Next, pressurized oil passes through second unlocking fluid passages 127 of bearing retainer 69 and into cylindrical bores 90 and 92 and first fluid passages 122 of second locking mechanism 110. The pressurized oil acts on the locking elements 112 of the second locking mechanism 110 so as to cause the locking elements 112 to move from the locked position shown in FIG. 6 to the unlocked position shown in FIG. 5.

With both locking mechanisms 108 and 110 in the unlocked position, the body portion 70 is able to move axially relative to the bearing retainer 69 from the extended position shown in FIG. 6 to the unextended position shown in FIG. 5. Such movement occurs as a result of inertia of the body portion 70. Once the body portion 70 reaches the unextended position, pressurized oil from first channel 76 acts on first locking mechanism 108 so as to move the locking elements 112 of the first locking mechanism 108 to the locked positions. More specifically, pressurized oil passes through first locking fluid passages 126 of bearing retainer 69 and into cylindrical bores 80 and 82 and second fluid passages 124 of first locking mechanism 108. The pressurized oil acts on the locking elements 112 of the first locking mechanism 108 so as to cause the locking elements 112 to move from the unlocked position shown in FIG. 6 to the locked position shown in FIG. 5.

When the engine controller 16 determines that it is desirable to change back to high compression mode, the engine controller 16 may control operation of the fluid supply system 14 so as to route pressurized oil through the second passage arrangement 42. Next, pressurized oil may travel through second crankshaft passage arrangement 146 and second bearing aperture or apertures (not shown) in bearing 71, and then into second channel 77 of bearing retainer 69. Pressurized oil passing from second channel 77, through first unlocking fluid passages 125, then acts on the first locking mechanism 108 so as to move the associated locking elements 112 to the unlocked position, thereby allowing the body portion 70 to move from the unextended position shown in FIG. 5 to the extended position shown in FIG. 6. Once the body portion 70 reaches the extended position, pressurized oil passing from second channel 77, through second locking fluid passages 128, acts on second locking mechanism 110 so as to cause the associated locking elements 112 to move to the locked positions shown in FIG. 6.

The connecting rod assembly 32 of the invention includes several beneficial aspects. First, as shown in the FIGS. 5 and 6, the locking mechanisms 108 and 110 may be disposed entirely between the bearing retainer 69 and the body portion 70, so that no additional housing portions, such as extruded housing portions, are required to contain the locking mechanisms 108 and 110. Thus, the connecting rod assembly 32 can be utilized with conventional crankshafts with minimal, if any, additional machining being required on the crankshafts.

Further, each locking element 112 is compressively loaded, rather than shear loaded, between the bearing retainer 69 and the body portion 70 when the locking element 112 is in the locked position. Such compressive loading reduces the possibility of bending the locking elements 112.

In addition, because the cylindrical portions 114 of the locking elements 112 mate with the cylindrical bores 80, 82, 90 and 92, the locking elements 112 may exhibit smooth lateral movement. In other words, the cylindrical bores 80, 82, 90 and 92 may act as guides for controlling lateral movement of the locking elements 112.

Furthermore, because the connecting rod assembly 32 may be manufactured with close tolerances between the cylindrical portions 114 and the cylindrical bores 80, 82, 90 and 92, fluid leakage around the cylindrical portions 114 may be minimized. Similarly, because the locking projections 115 closely mate with the extension apertures 84, 86, 94 and 96, fluid leakage from the cylindrical bores 80, 82, 90 and 92 may be minimized.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A connecting rod assembly for varying a compression ratio of an internal combustion engine, the engine having a crankshaft and a piston, the connecting rod comprising:

a first portion adapted to be connected to the crankshaft and having a cylindrical aperture;

a second portion adapted to be connected to the piston and movable with respect to the first portion; and a locking element having a cylindrical portion that is disposed at least partially in the cylindrical aperture, the locking element being movable between an unlocked position and a locked position for locking the second portion at a first position relative to the first portion, the first position corresponding to a first compression ratio of the engine.

2. The connecting rod assembly of claim 1 wherein the first portion is a bearing retainer and the second portion is a body portion.

3. The connecting rod assembly of claim 1 wherein the second portion has a longitudinally extending axis that extends in a first direction, and the locking element is movable in a second direction generally perpendicular to the first direction between the unlocked and locked positions.

4. The connecting rod assembly of claim 1 wherein the cylindrical portion has first and second ends, and the locking element further includes a locking projection extending from the first end, and wherein the locking projection is compressed between the first and second portions when the locking element is in the locked position.

5. The connecting rod assembly of claim 4 wherein the locking projection has first and second generally planar surfaces that are respectively engaged with the first and second portions when the locking element is in the locked position, and first and second arcuate surfaces that extend between the planar surfaces.

6. The connecting rod assembly of claim 4 wherein the locking projection has a cross-section that is defined by two generally parallel lines joined by two semicircles.

7. The connecting rod assembly of claim 4 wherein the cylindrical portion includes an aperture that extends from the second end toward the first end, and wherein the connecting rod assembly further includes a spring disposed at least partially in the aperture and engaged with the locking element for urging the locking element toward the locked position.

8. The connecting rod assembly of claim 7 wherein the aperture has a cylindrical shape.

9. The connecting rod assembly of claim 4 wherein the cylindrical portion includes a fluid passage disposed at the second end of the cylindrical portion, the fluid passage being configured to receive fluid that is used to urge the locking element toward the locked position.

10. The connecting rod assembly of claim 9 wherein the fluid passage is a radially extending channel.

11. The connecting rod assembly of claim 4 wherein the cylindrical portion includes a fluid passage disposed at the first end of the cylindrical portion, the fluid passage being configured to receive fluid that is used to urge the locking element toward the unlocked position.

12. The connecting rod assembly of claim 11 wherein the fluid passage extends around the locking projection.

13. A connecting rod assembly for varying a compression ratio of an internal combustion engine, the engine including a cylinder, a reciprocating piston disposed within the cylinder, and a crankshaft having a crankpin, the connecting rod comprising:

a bearing retainer adapted to be connected to the crankpin and having first and second ends, the bearing retainer further having a first cylindrical bore and a first slot disposed proximate the first end, and a second cylindrical bore and a second slot disposed proximate the second end;

a body portion adapted to be connected to the piston, the body portion having a longitudinal body portion axis and being axially movable with respect to the bearing retainer to effect a selective displacement of the body portion relative to the bearing retainer, the displacement causing a change in the effective length of the body portion and the compression ratio of the engine;

a first locking mechanism including a first locking element that is movable between an unlocked position and a locked position, the first locking element having a first cylindrical portion and a first projection extending from the first cylindrical portion, the first cylindrical portion being disposed in the first cylindrical bore and having a first aperture, and the first projection extending through the first slot, the first locking mechanism further including a first spring disposed at least partially in the first aperture and engaged with the first locking element for urging the first locking element toward the locked position; and a second locking mechanism including a second locking element that is movable between an unlocked position and a locked position, the second locking element having a second cylindrical portion and a second projection extending from the second cylindrical portion, the second cylindrical portion being disposed in the second cylindrical bore and having a second aperture, and the second projection extending through the second slot, the second locking mechanism further including a second spring disposed at least partially in the second aperture and engaged with the second locking element for urging the second locking element toward the locked position;

wherein the first locking element is configured to lock the body portion at a first position relative to the bearing retainer when the first locking element is in the locked position and the second locking element is in the unlocked position, the first position corresponding to a first compression ratio of the engine, and the second locking element is configured to lock the body portion at a second position relative to the bearing retainer when the second locking element is in the locked position and the first locking element is in the unlocked position, the second position corresponding to a second compression ratio of the engine, and wherein the second compression ratio is larger than the first compression ratio.

14. A variable compression engine comprising:

a crankshaft;

a reciprocating piston;

a connecting rod assembly including a first portion connected to the crankshaft and having a cylindrical aperture, a second portion connected to the piston and movable with respect to the first portion, and a locking element having a cylindrical portion that is disposed at least partially in the cylindrical aperture, the locking element being movable between an unlocked position and a locked position for locking the second portion at a first position relative to the first portion, the first position corresponding to a first compression ratio of the engine.

15. The engine of claim 14 wherein the first portion is a bearing retainer and the second portion is a body portion.

16. The engine of claim 14 wherein the second portion has a longitudinally extending axis that extends in a first direction, and the locking element is movable in a second direction generally perpendicular to the first direction between the unlocked and locked positions.

17. The engine of claim 14 wherein the cylindrical portion has first and second ends, and the locking element further includes a locking projection extending from the first end, and wherein the locking projection is compressed between the first and second portions when the locking element is in the locked position.

18. The engine of claim 17 wherein the locking projection has first and second generally planar surfaces that are respectively engaged with the first and second portions when the locking element is in the locked position, and first and second arcuate surfaces that extend between the planar surfaces.

19. The engine of claim 17 wherein the locking projection has a cross-section that is defined by two generally parallel lines joined by two semicircles.

20. The engine of claim 17 wherein the cylindrical portion includes an aperture that extends from the second end toward the first end, and wherein the connecting rod assembly further includes a spring disposed at least partially in the aperture and engaged with the locking element for urging the locking element toward the locked position.

21. The engine of claim 20 wherein the aperture has a cylindrical shape.

22. The engine of claim 17 wherein the cylindrical portion includes a fluid passage disposed at the second end of the cylindrical portion, the fluid passage being configured to receive fluid that is used to urge the locking element toward the locked position.

23. The engine of claim 22 wherein the fluid passage is a radially extending channel.

24. The engine of claim 17 wherein the cylindrical portion includes a fluid passage disposed at the first end of the cylindrical portion, the fluid passage being configured to receive fluid that is used to urge the locking element toward the unlocked position.

25. The engine of claim 24 wherein the fluid passage extends around the locking projection.

* * * * *